US010751870B2

(12) United States Patent
Bain

(10) Patent No.: US 10,751,870 B2
(45) Date of Patent: Aug. 25, 2020

(54) GUIDE ASSEMBLY AND TOOL SYSTEM FOR ROTATABLY BALANCING A TOOL AND A METHOD FOR OPERATING THE SAME

(71) Applicant: The Boeing Company, Chicago, IL (US)

(72) Inventor: David Michael Bain, Ashburn (AU)

(73) Assignee: The Boeing Company, Chicago, IL (US)

( * ) Notice: Subject to any disclaimer, the term of this patent is extended or adjusted under 35 U.S.C. 154(b) by 238 days.

(21) Appl. No.: 15/806,185

(22) Filed: Nov. 7, 2017

(65) Prior Publication Data

US 2019/0134806 A1 May 9, 2019

(51) Int. Cl.
*B25H 1/00* (2006.01)

(52) U.S. Cl.
CPC ..... *B25H 1/0078* (2013.01); *B25H 1/0028* (2013.01)

(58) Field of Classification Search
CPC ... B25H 1/0078; B25H 1/0028; B25H 1/0057
USPC ..... 227/82; 248/324, 325, 326, 327, 328, 248/329
See application file for complete search history.

(56) References Cited

U.S. PATENT DOCUMENTS 4,451,952 A * 6/1984 Herubel ..... B25H 1/0028 452/62
4,592,258 A * 6/1986 Halm ..... B25H 1/0028 81/57.4
5,520,311 A * 5/1996 Lam ..... A47G 25/20 223/85
5,836,811 A * 11/1998 Schoeps ..... B25F 5/02 452/62
5,931,060 A * 8/1999 Brown ..... B25B 21/00 81/177.1
6,431,514 B1 * 8/2002 Ailing ..... B25H 1/0028 248/315
7,303,028 B2 * 12/2007 Wu ..... B25F 5/02 173/170
8,708,253 B2 * 4/2014 Hilfiker ..... B05C 5/02 239/525

(Continued)

OTHER PUBLICATIONS

"Customizing Options Makes New Gear Keeper Retractable Tool Tether a Pertect Fit", Coraline by WordPress.com., Sep. 2014 retrieved from http://www.avera-distributing.eu/category/gearkeeper-s/.

(Continued)

*Primary Examiner* — Chelsea E Stinson
*Assistant Examiner* — Himchan Song
(74) *Attorney, Agent, or Firm* — Felix L. Fischer

(57) ABSTRACT

A guide assembly for supporting a tool employs an arcuate guide configured to have a tether coupled thereto. The arcuate guide is configured to apply a reaction force to the tether to oppose gravitational force applied to the tool. The assembly further includes a mount assembly is configured to couple the arcuate guide to the tool. At least one support bar is coupled to the arcuate guide and the mount assembly. The arcuate guide, the mount assembly, and the at least one support bar are configured to maintain the reaction force in alignment with a center of gravity of the tool as the tool is rotated with respect to the center of gravity.

20 Claims, 14 Drawing Sheets

(56) References Cited

U.S. PATENT DOCUMENTS

| | | | | |
|---|---|---|---|---|
| 2006/0025060 | A1* | 2/2006 | Funk | B25F 5/02<br>451/358 |
| 2008/0135819 | A1* | 6/2008 | Achtari | B25H 1/0028<br>254/270 |

OTHER PUBLICATIONS

"Handheld Tongs"; TOX PRESSOTECHNIK, retrieved from https://www.tox-us.com/products/tongs/handheld-tongs/.

* cited by examiner

GUIDE ASSEMBLY AND TOOL SYSTEM FOR ROTATABLY BALANCING A TOOL AND A METHOD FOR OPERATING THE SAME

FIELD

Implementations shown in the disclosure relate generally to tool support systems and more particularly to implementations for a guide assembly to balance a tool for rotation and tilt without undesirable additional torque on an operator's hand, wrist, or arm.

BACKGROUND

Pneumatic or electrically powered tools are employed by mechanics and assemblers during manufacturing and maintenance operations. Many tools are used repeatedly positioned and oriented manually by an operator during a shift. Typical of those tools are pneumatically operated drill motors, such as a nutplate drill motor. These drill motors can be quite heavy. To alleviate some issues associated with the weight of the drill motor, the drill motor can be attached to a robot for automated drilling. However, robots and automation can be expensive, and the robot may not be able to fit in confined spaces. When manual drilling is performed, the drill motor can be supported by a gimbal. The gimbal may have a center of gravity that conflicts with the center of gravity of the drill motor, which would impart a moment force to the operator's hand/wrist. Further, the gimbal may interfere with the operator's hand on the tool. An alternative is to support the weight of the tool by using an overhead winch. However, the cable attached to the winch may prevent rotation of the tool or the cable arrangement may impart a torque to the operator's hand, wrist, or arm when drilling non-horizontal holes. Accordingly, even where an overhead winch or gimbal is provided, operators may not find the winch or gimbal to be convenient in operation and may not use the winch or gimbal consistently.

SUMMARY

Exemplary implementations provide a guide assembly for supporting a tool. The guide assembly has an arcuate guide configured to have a tether coupled thereto. The arcuate guide is configured to apply a reaction force to the tether to oppose gravitational force applied to the tool. The assembly further includes a mount assembly is configured to couple the arcuate guide to the tool. At least one support bar is coupled to the arcuate guide and the mount assembly. The arcuate guide, the mount assembly, and the at least one support bar are configured to maintain the reaction force in alignment with a center of gravity of the tool as the tool is rotated with respect to the center of gravity.

A system implementation provides a tool system having an overhead support. A tether is coupled to the overhead support. A tool having a center of gravity is coupled to a guide assembly. The guide assembly has an arcuate guide configured to be coupled to the tether, the tether opposing gravitational force on the tool with a reaction force on the arcuate guide. A mount assembly is configured to couple the arcuate guide to the tool. At least one support bar coupled to the arcuate guide and the mount assembly, wherein the arcuate guide, the mount assembly, and the at least one support bar are configured to maintain the reaction force in alignment with a center of gravity of the tool as the tool is rotated with respect to the tether.

The exemplary implementations allow a method for operation of a tool having a tool center of gravity. A tether is coupled to the guide assembly. The tool is rotated about a roll axis such that the tether slides relative to the arcuate guide to maintain the reaction force in alignment with the tool center of gravity.

BRIEF DESCRIPTION OF THE DRAWINGS

The features, functions, and advantages that have been discussed can be achieved independently in various implementations or may be combined in yet other implementations further details of which can be seen with reference to the following description and drawings.

DETAILED DESCRIPTION

The exemplary implementations described herein provide a tool guide assembly that includes an arcuate guide that keeps an upward force applied by a support over a center of gravity of a tool as the tool is rotated (i.e., rolled or pitched). The support may be provided by a tether, a tool balance arm, or other suspending device providing a single point of attachment. The description and drawings of the implementations herein employ a cable or fabric tether but as used herein the term "tether" is defined as any overhead single point support. The tether attaches to the arcuate guide with a clip. In exemplary implementations, the arcuate guide is a rail and the clip slides along the guide rail as the tool is rolled to drill holes that are not perpendicular to a surface of a workpiece. Slight friction between the tether clip and the guide rail maintains a position/orientation (i.e., angle) of the guide rail with respect to the tether as a hole is drilled. Alternatively, a bearing or bushing around the guide rail may be employed to reduce friction along the guide rail when the clip slides along the guide rail. An alternative exemplary implementation of the guide assembly includes a plate with an arcuate slot cut through the plate. Either the slotted plate or the guide rail can include engaging indices, such as notches or bumps, to maintain a fixed angle of rotation of the tool. In exemplary implementations, the notches, indentations, or bumps can be spaced along the inner surface of the guide rail or arcuate slot at predetermined increments, such as 5° increments. The tool can be, for example, a hand tool or a manually-operated power tool. In a particular embodiment, the tool is an electrically-powered drill motor that is manually positioned and oriented by an operator.

Figure 1A:
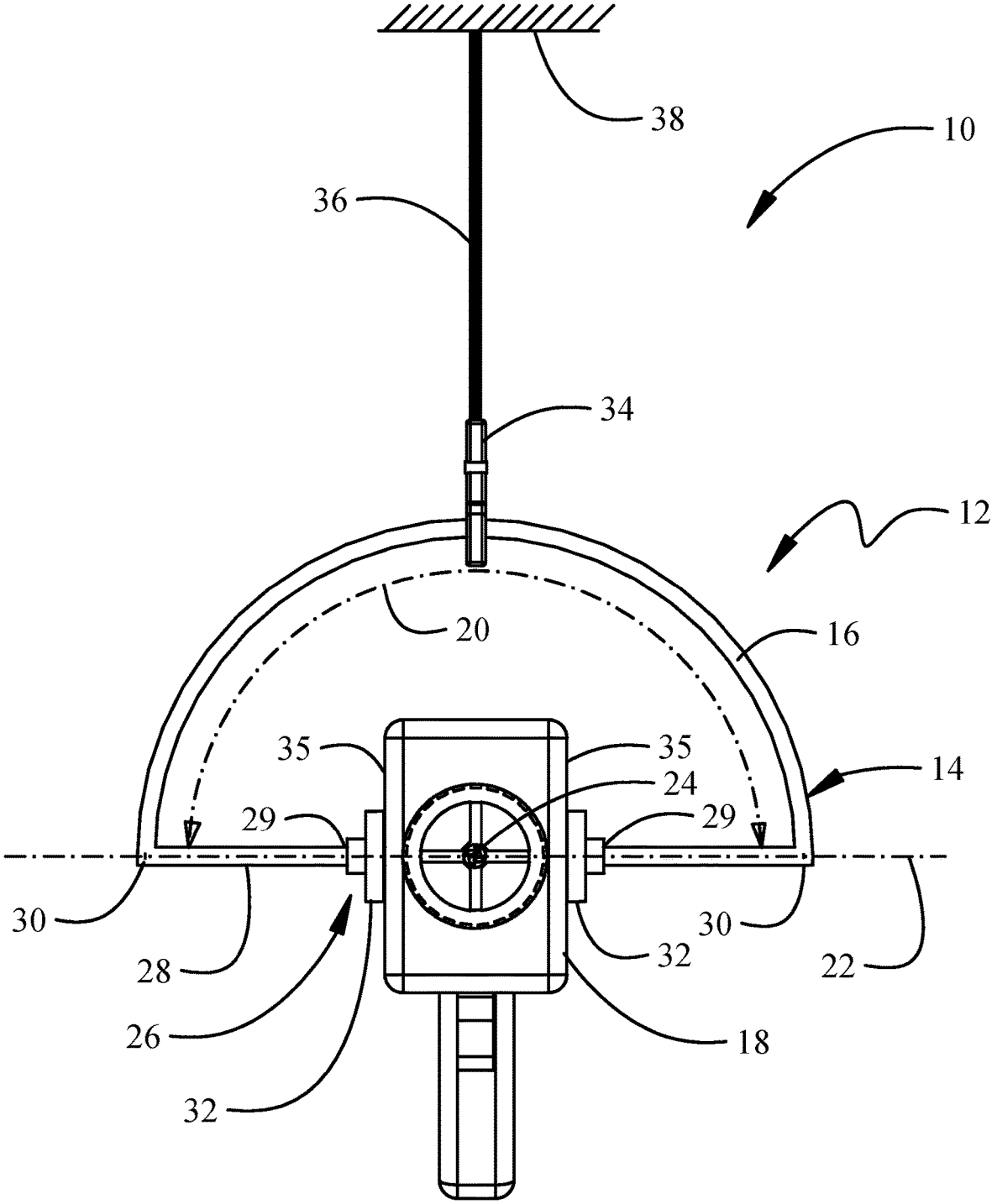
FIGS. 1A, 1B, and 1C show a front, side, and pictorial representation, respectively, of a first exemplary implementation of a tool system.
Figure 1B:
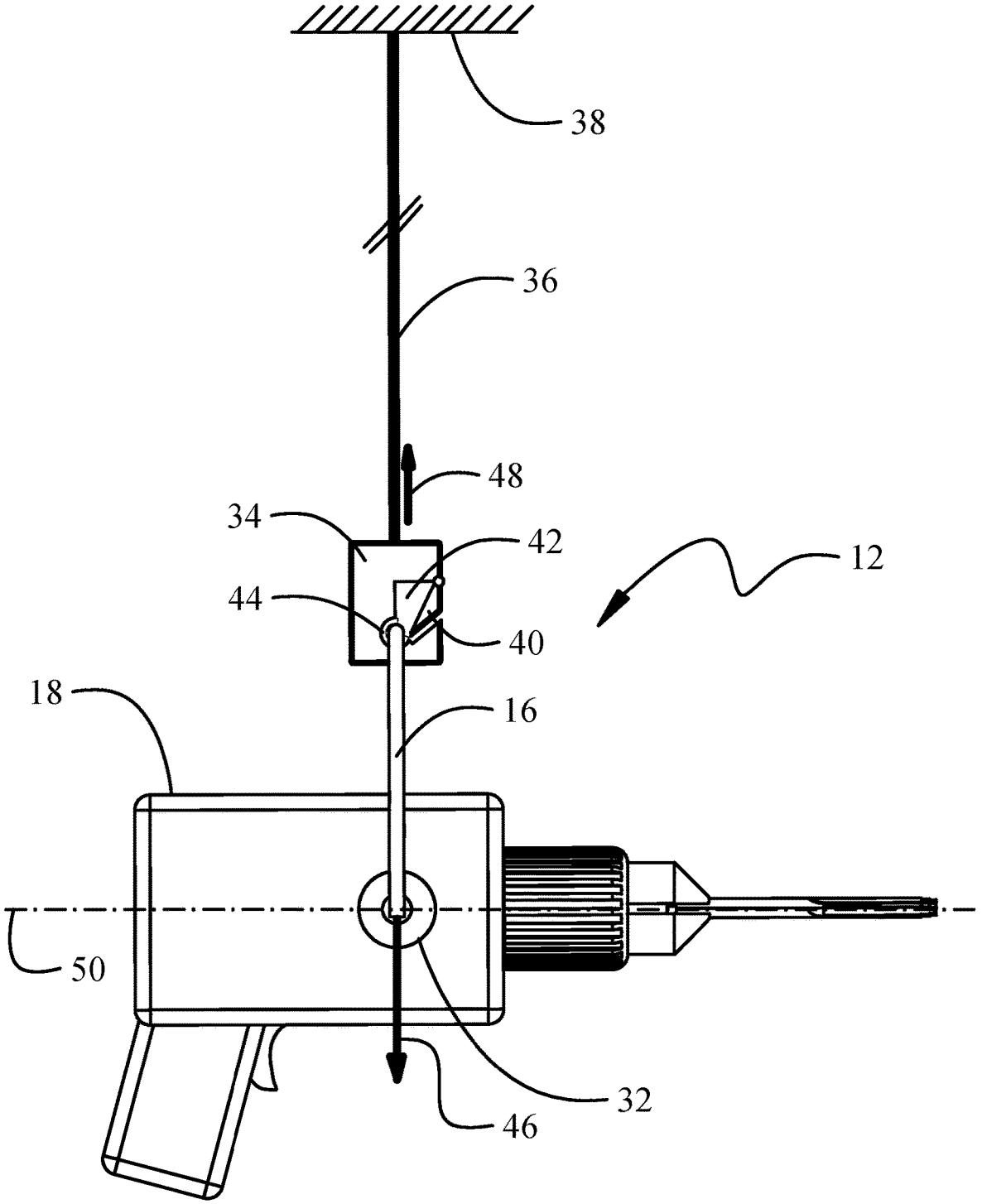
Figure 1C:
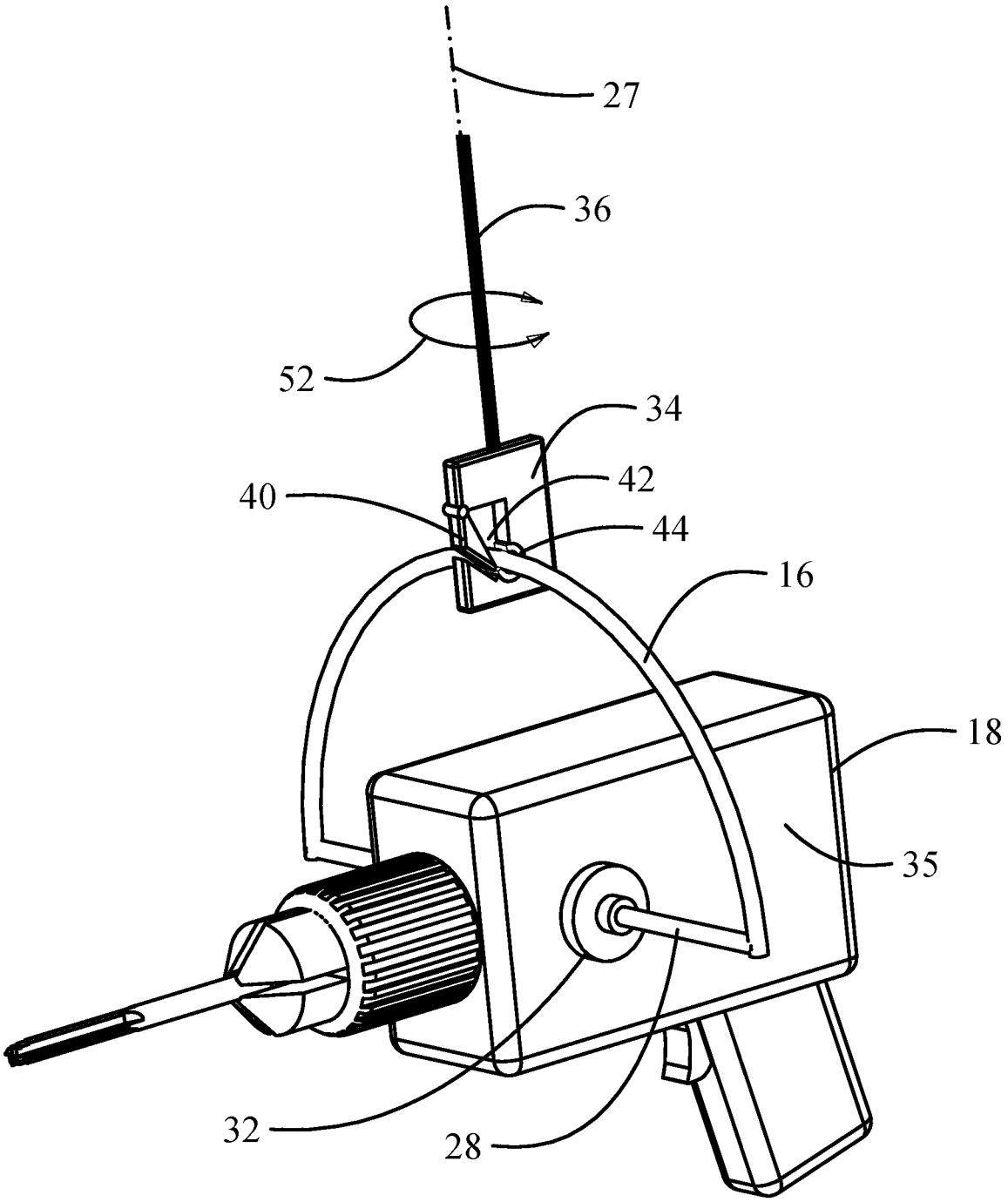

Referring to the drawings, FIGS. 1A, 1B, and 1C show a front, side, and pictorial representation, respectively, of a first exemplary implementation of a tool system 10 having a guide assembly 12. The guide assembly 12 employs an arcuate guide 14 in the form of a rail 16. The rail 16 extends arcuately over a tool 18. In the exemplary implementation shown, nominally a 180° arc 20 with respect to an axis 22 through a center of gravity 24 of the tool 18 is employed. However, if a smaller range of angular motion is desired, the arc 20 may be less than 180° and, if a larger range of angular motion is desired, the arc 20 may be more than 180°. In this initial exemplary implementation, the rail 16 is attached to a mount assembly 26 having a support bar 28 attaching ends 30 of the rail 16 to rotating trunnions 32. In this implementation, the support bar 28 is bifurcated into two support bars 28*a*, 28*b* to attach at inner ends 29*a*, 29*b* to the trunnions 32. The trunnions 32 are mounted to or extend from opposing sides 35*a*, 35*b* of the tool 18. When the tool 18 is in a neutral position, a horizontal axis 25 extends through the trunnions 32. The support bar 28 can be coaxial with the axis 22 when the arc 20 is 180°. In implementations with arc 20 less than 180° and/or where the rigidity of the mount assembly 26 is sufficient to support the weight of the hand tool 18, a single support bar 28 attached to one end 30 of the rail 16 and cantilevered to one trunnion 32 may be employed as seen in FIG. 1F, which also incorporates a combined stop and counterbalance 33.

The tool system 10 has a tether 36 suspended from an overhead support 38. The tether 36 can suspend a clip 34 from the overhead support 38. Details of the overhead support 38 are not shown, but the overhead support 38 may be a winch, a gantry, an overhead beam, a crane, or a ceiling attachment. The overhead support 38 may provide two or three-dimensional positioning of the tool 18. The overhead support 38 may provide vertical adjustment of the length or height of the tether 36 to assist in positioning the tool 18 for operation. The clip 34 may be permanently engaged to the rail 16 but normally employs a gate 40 pivotally movable to allow insertion of the rail 16 into an aperture 42 defined by the clip 34. The clip 34 may be sufficiently lubricious to allow the rail 16 to slip laterally through the aperture 42. A bushing or bearing 44 is alternatively attached to either the clip 34 or the rail 16. The bearing 44 can enhance sliding movement of the rail 16 through the clip 34 providing greater lubricity than the direct contact of the materials of the clip 34 and rail 16, for roll movement as will be described in greater detail subsequently. In a simplified implementation, the tether 36 may be looped around the rail 16 and secured to itself with the loop replacing the clip 34.

The force of gravity acting on the tool 18 (represented by arrow 46) through the center of gravity 24 is reacted by the guide assembly 12 to the overhead support 38 with a reaction force 48 nominally axially centered in the tether 36 but shown offset from the tether for clarity. The arcuate guide 14 is configured to apply the reaction force 48 to the tether 36 to oppose gravitational force applied to the tool 18. In other words, the tether 36 opposes the gravitational force with the reaction force 48 applied on the arcuate guide 14. The operator can therefore operate the tool 18 without having to support the weight of the tool 18 with a vertically-applied force. The arcuate guide 214 and the guide assemblies 212, 312, 314 described in more detail below function similarly to the arcuate guide 14 to applying the reaction force 48 that opposes the gravitational force.

Figure 1D:
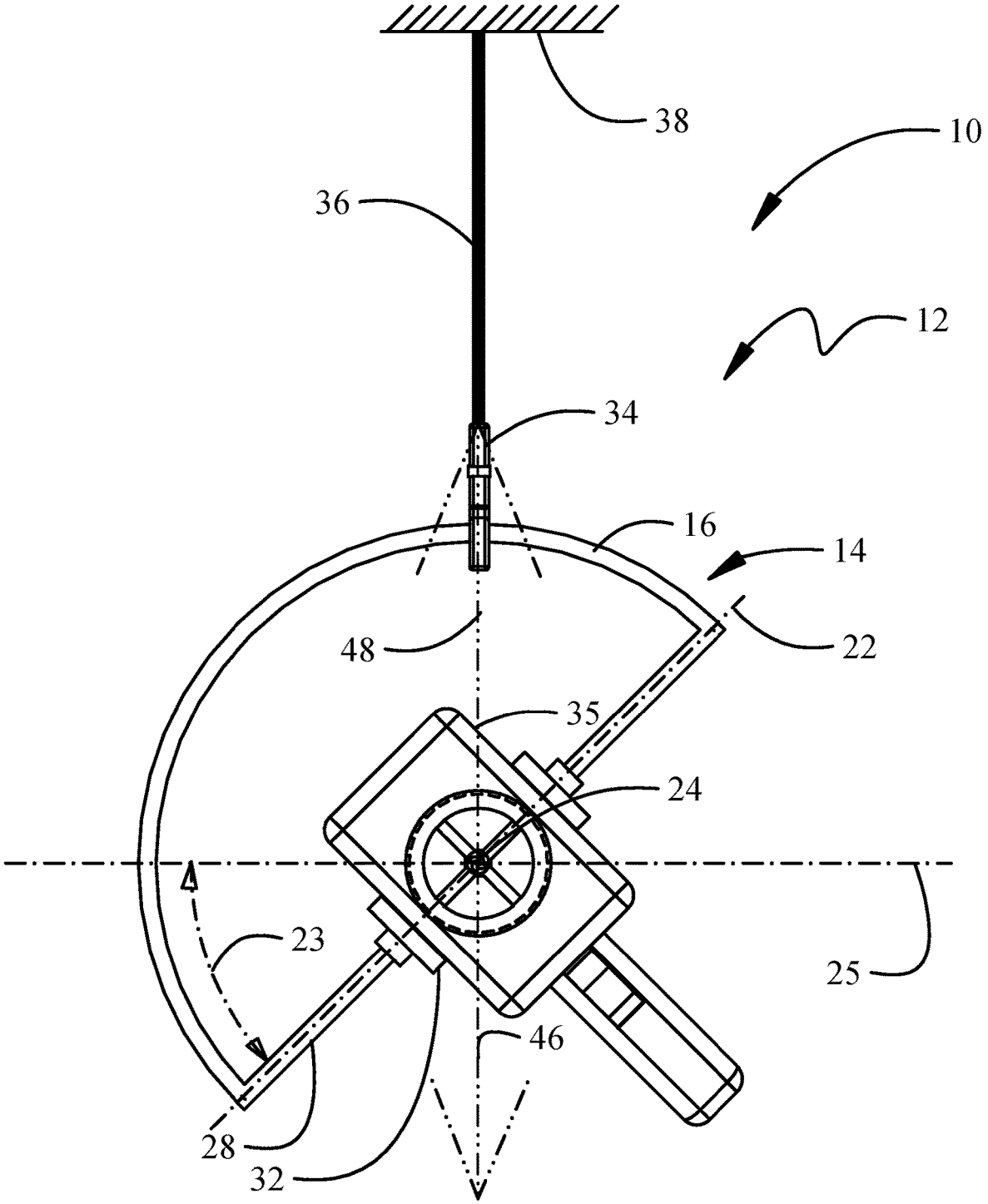
FIG. 1D shows a front view of the first exemplary implementation with a tool rotated in roll.
Figure 1E:
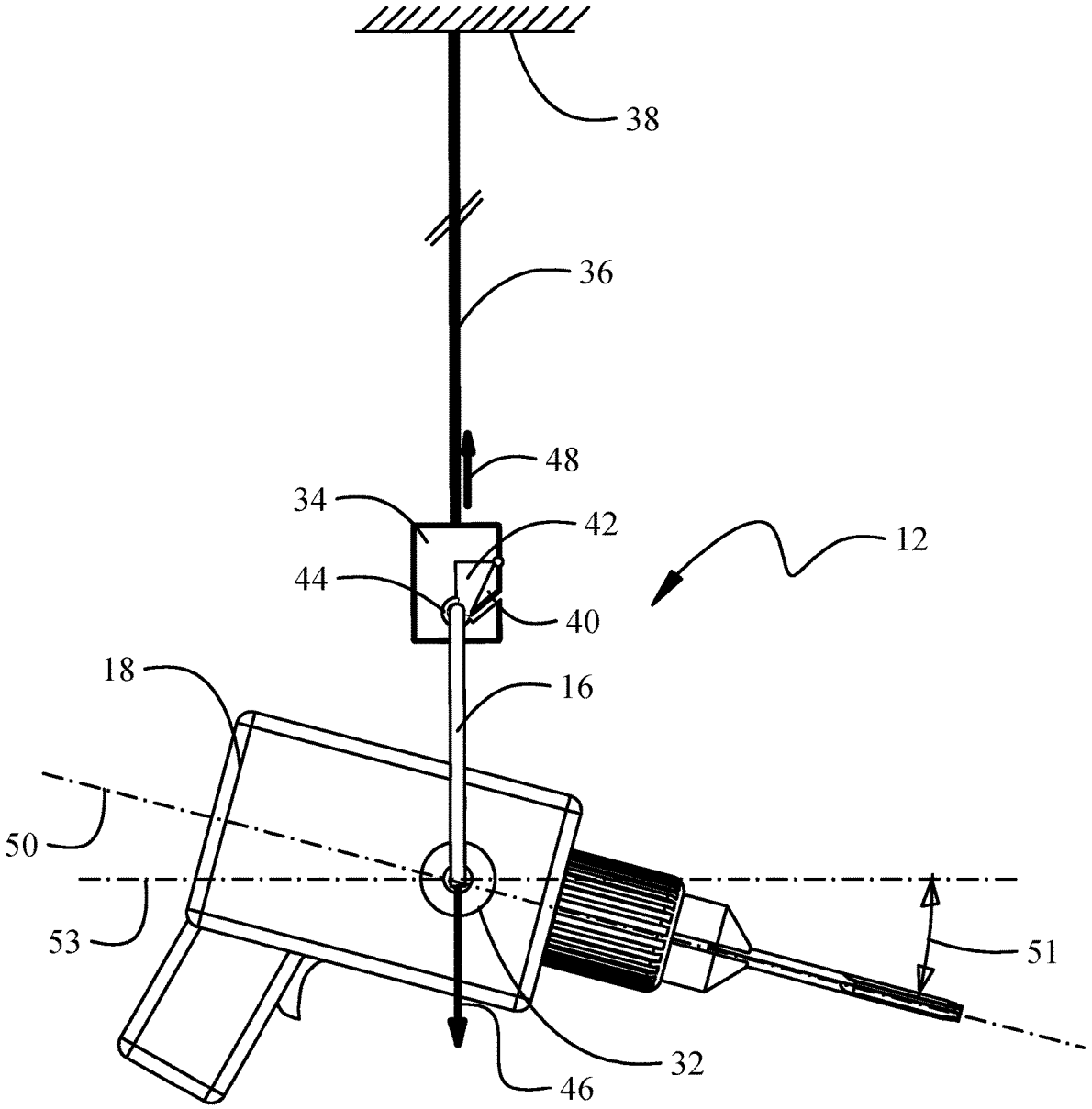
FIG. 1E shows a side view of the first exemplary implementation with the tool rotated in pitch.
Figure 1F:
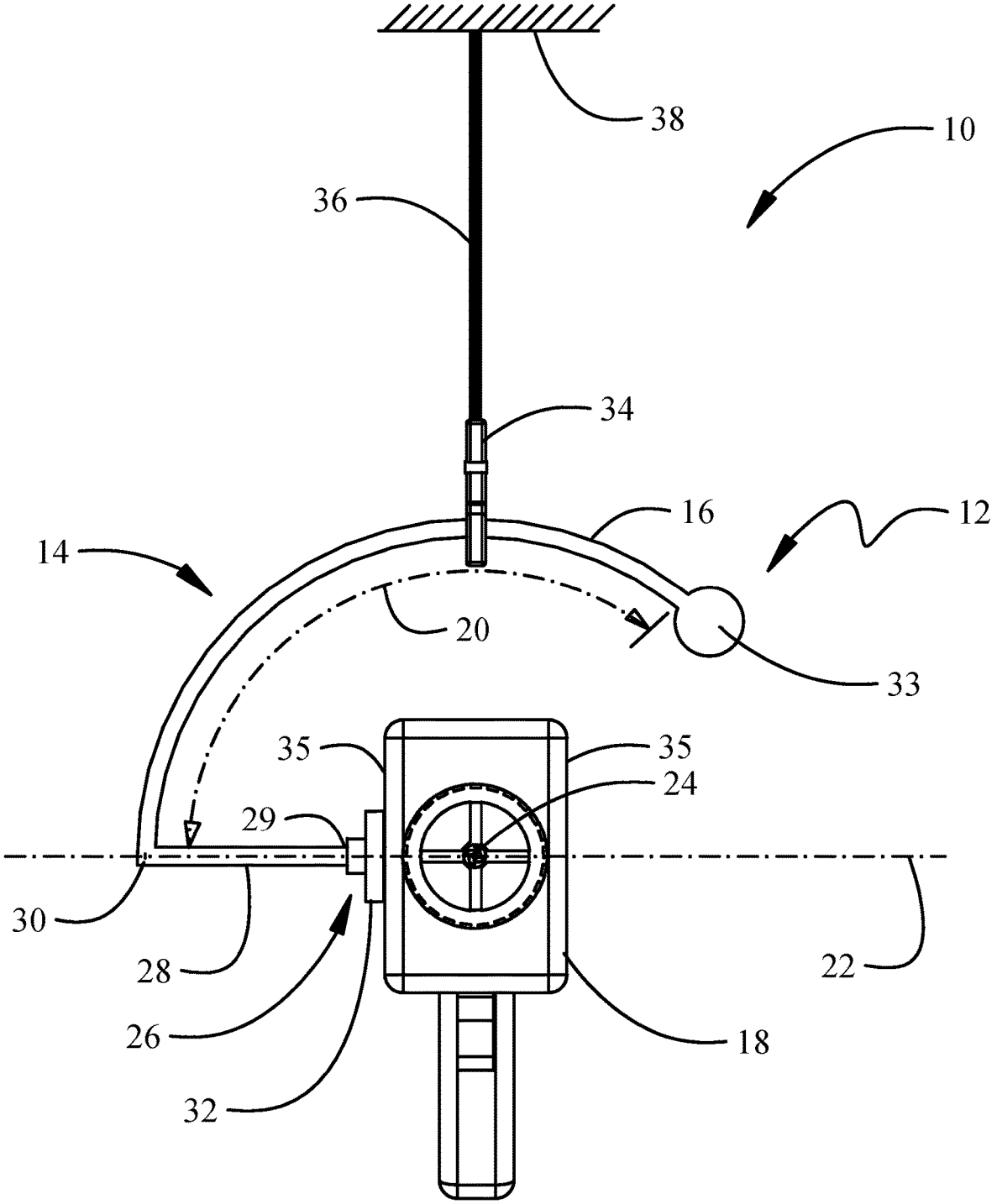
FIG. 1F shows a front view of an alternative implementation with reduced arc.

As seen in FIG. 1D, the tool 18 may be rotated about a roll axis 53 (seen in FIG. 1E which is coincident with a tool axis 50 with no pitch as seen in FIG. 1B) extending through the center of gravity 24 by sliding the clip 34 about the rail 16 to a desired angle 23 with respect to a horizontal axis 25 extending through the center of gravity 24. Additionally, as shown in FIG. 1E, the tool 18 may be rotated in pitch about the axis 22 (seen in FIG. 1A) extending through the center of gravity 24 by rotation of the mount assembly 26 using the trunnions 32. With the tool 18 in a neutral roll (no roll as shown in FIG. 1A) an exemplary pitch angle 51 is shown about a second horizontal axis 53 in FIG. 1E. Additionally, the tool 18 may be rotated in yaw (represented by arrow 52 in FIG. 1C) about a yaw axis 27 through the tether 36 coincident with reaction force 48. This three-axis rotational capability created by the guide assembly 12 allows the operator to position the tool 18 at any desired angle for operation. The arcuate guide 14, the mount assembly 26, and the support bar 28 are configured to maintain the reaction force 48 in alignment with the center of gravity 24 of the tool 18 as the tool 18 is rotated with respect to the center of gravity 24 and rotation in roll (as seen in FIG. 1D with representations of the reaction force 48 and gravity force 46 enhanced), pitch, or yaw maintains alignment of the tether 36 with the center of gravity 24 thus aligning the gravitational force 46 and reaction force 48 and does not induce torque on the operator's hand wrist or arm to support the tool 18 since the various axes 22, 53, 27 of rotation extend through the center of gravity 24.

Figure 2A:
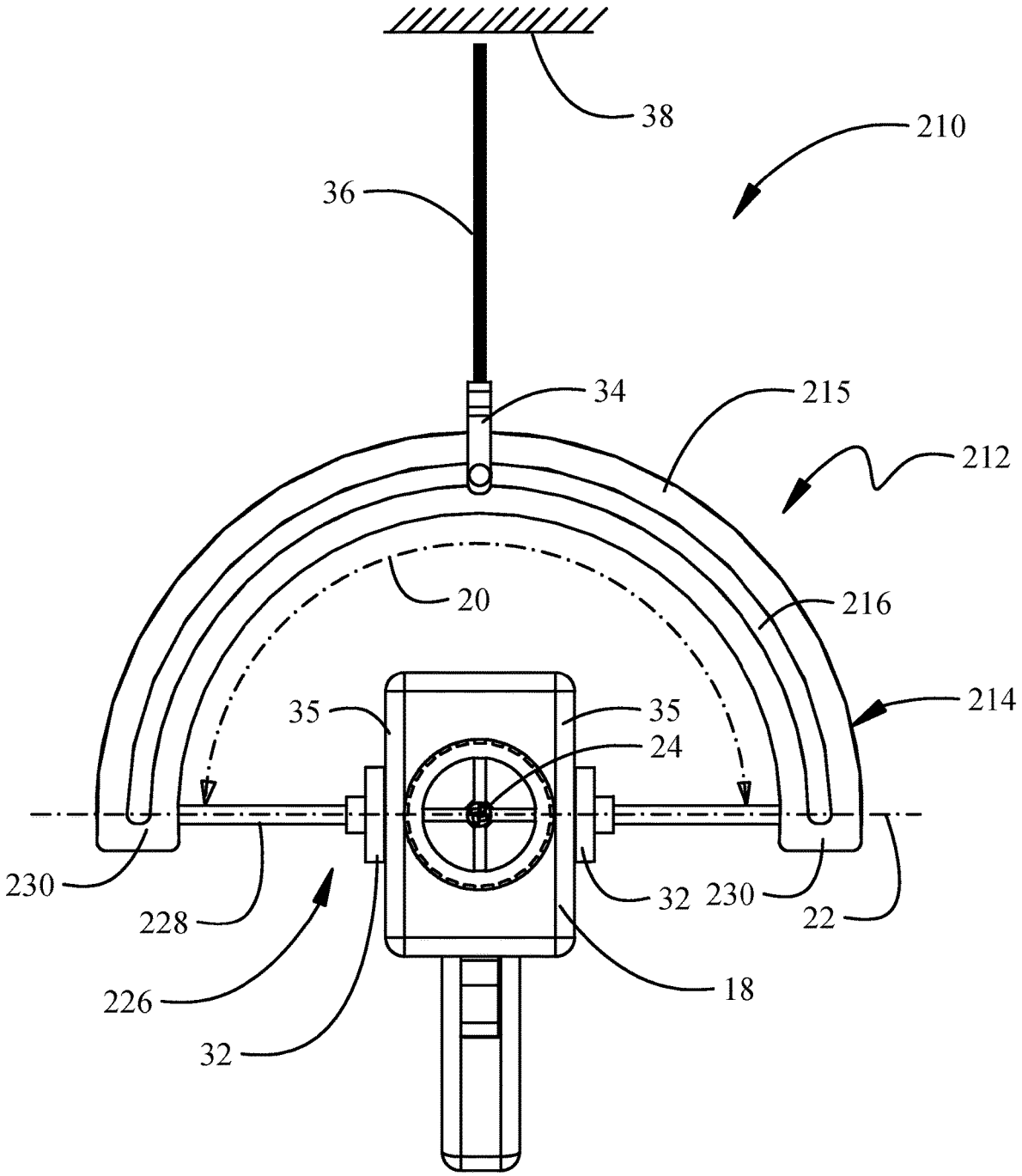
FIGS. 2A, 2B, and 2C show a front, side, and pictorial representation, respectively, of a second exemplary implementation of a tool system.
Figure 2B:
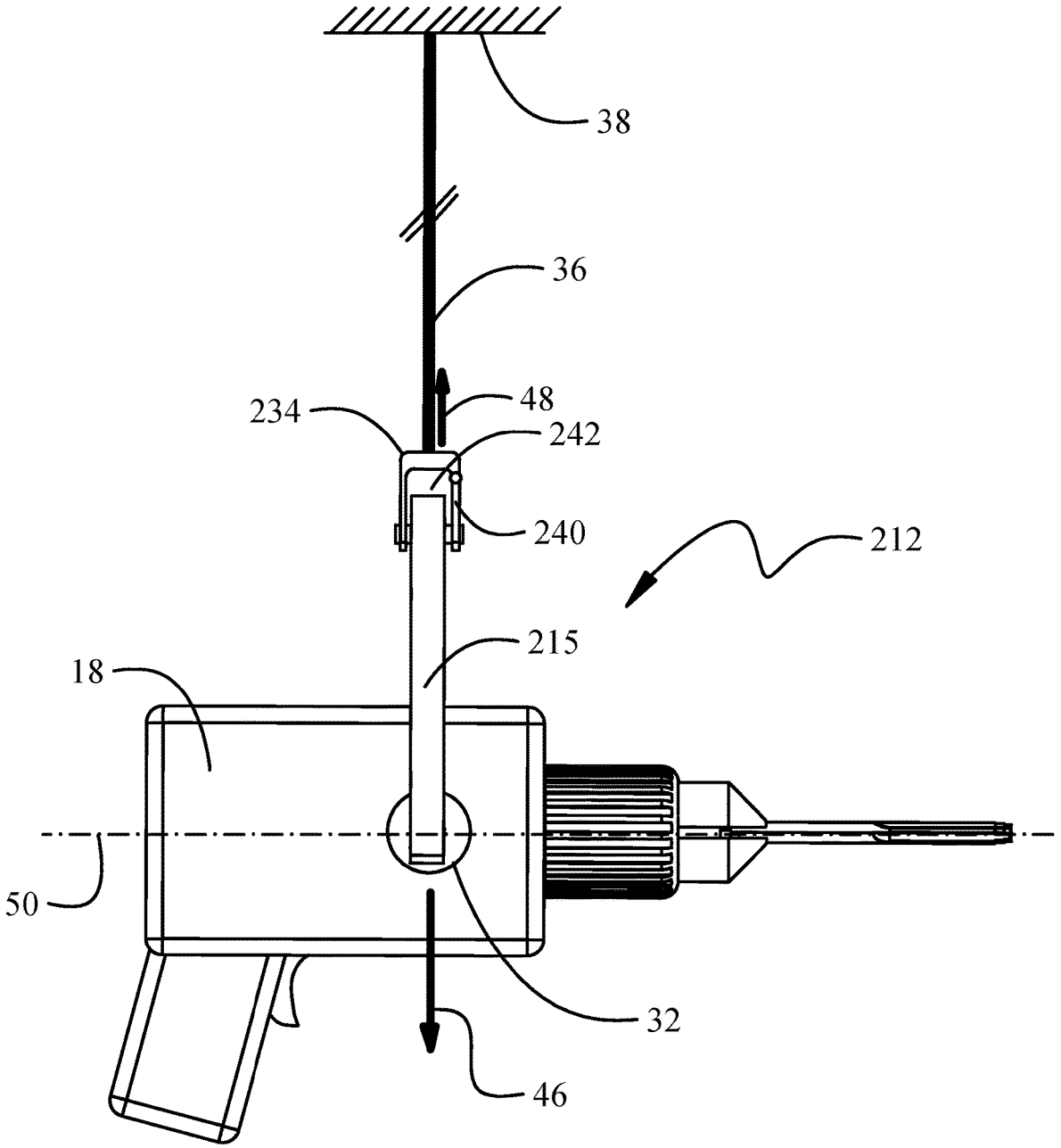
Figure 2C:
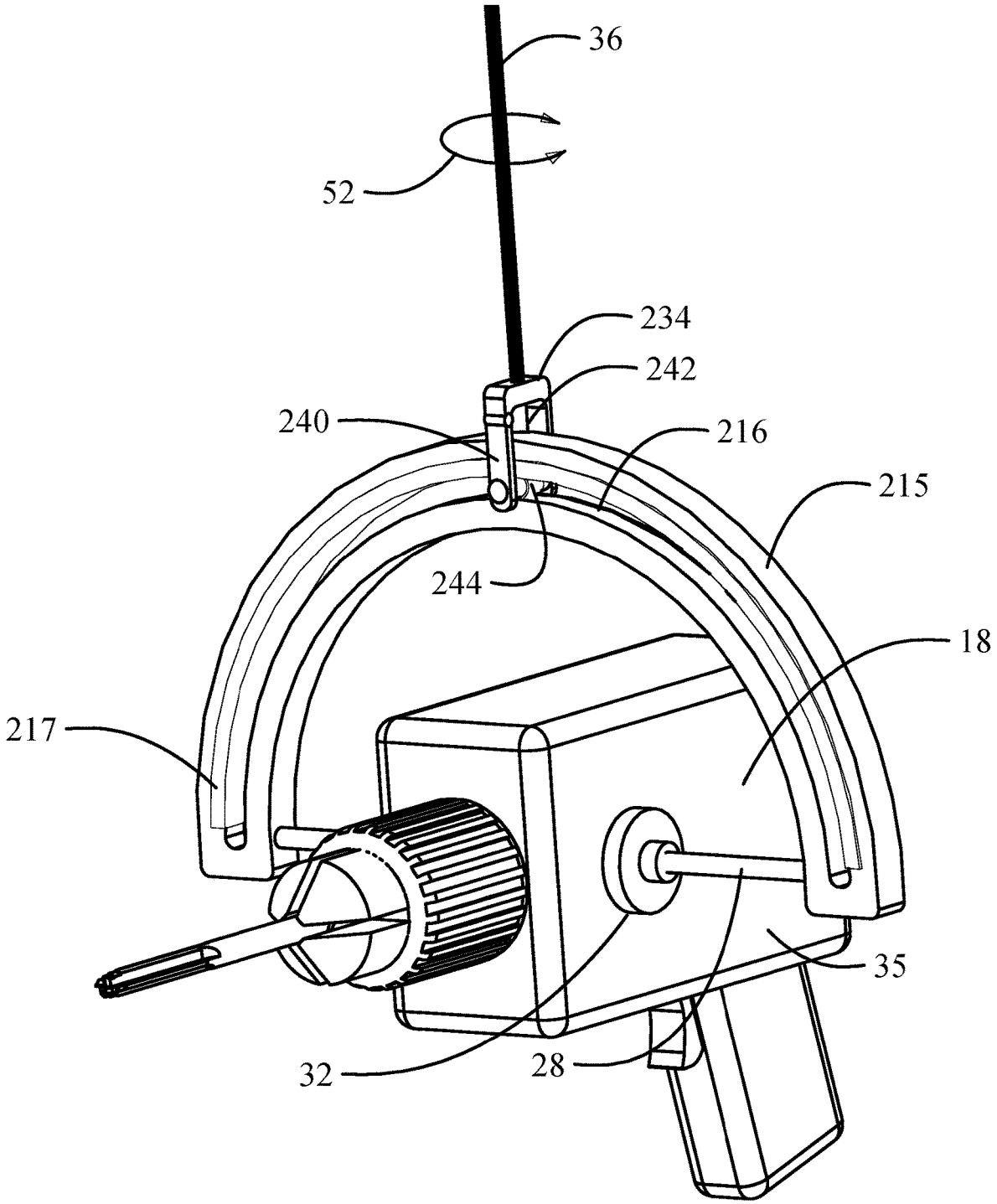

FIGS. 2A, 2B, and 2C show a front, side, and pictorial representation, respectively, of a second exemplary implementation of a tool system 210 having a guide assembly 212. The guide assembly 212 employs an arcuate guide 214 in the form of a plate 215 having an arcuate slot 216. The arcuate slot 216 extends arcuately over the tool 18 with a nominal 180° arc 20 from the axis 22 through a center of gravity 24 of the tool 18. A lesser arc 20 may be accommodated in a manner similar to that described with respect to FIG. 1F. In this initial exemplary implementation, the plate 215 is attached to a mount assembly 226 having a support bar 228 attaching peripheral ends 230 of the plate 215 to rotating trunnions 32. As with the prior described implementation the support bar 228 is bifurcated to attach to the trunnions 32 which are mounted to or extend from the sides 35 of the tool 18. Axis 22 extends through the trunnions 32.

The tool system 210 has a tether 36 suspended from the overhead support 38. The tether 36 can suspend a clip 234 from the overhead support 38. The clip 234 may be permanently engaged to the plate 215 but normally employs a gate 240 pivotally movable to allow insertion of the clip 234 into the arcuate slot 216. The clip 234 may be sufficiently lubricious to allow the clip 234 to slip laterally along the arcuate slot 216. Alternatively, a bushing or bearing 244 is attached to the clip 234 to enhance movement of the clip 234 along the arcuate slot 216. The arcuate slot 216 may incorporate a coating of lubricious material on which the clip 234 slides. The arcuate slot 216 may additionally or alternatively incorporate a grommet 217 received over an edge of the arcuate slot 216 (seen in FIG. 2C as covering only the top edge but covering the entire periphery of the slot 216 in alternative implementations). The grommet 217 can be formed of a friction-reducing material to facilitate movement of the clip along the slot 216. Operable rotation about the roll axis 53 (aligned with tool axis 50 in FIG. 2B) with clip 234 sliding in the arcuate slot 216, pitch about the axis 22 with support bar 28 rotating in trunnions 32, and yaw about the tether 36 are substantially identical to the prior described implementation.

For the implementations as shown in FIGS. 1A-1E and 2A-2C, the rail 16 or arcuate slot 216 are circular arcs to be geometrically concentric about the center of gravity 24.

Figure 3:
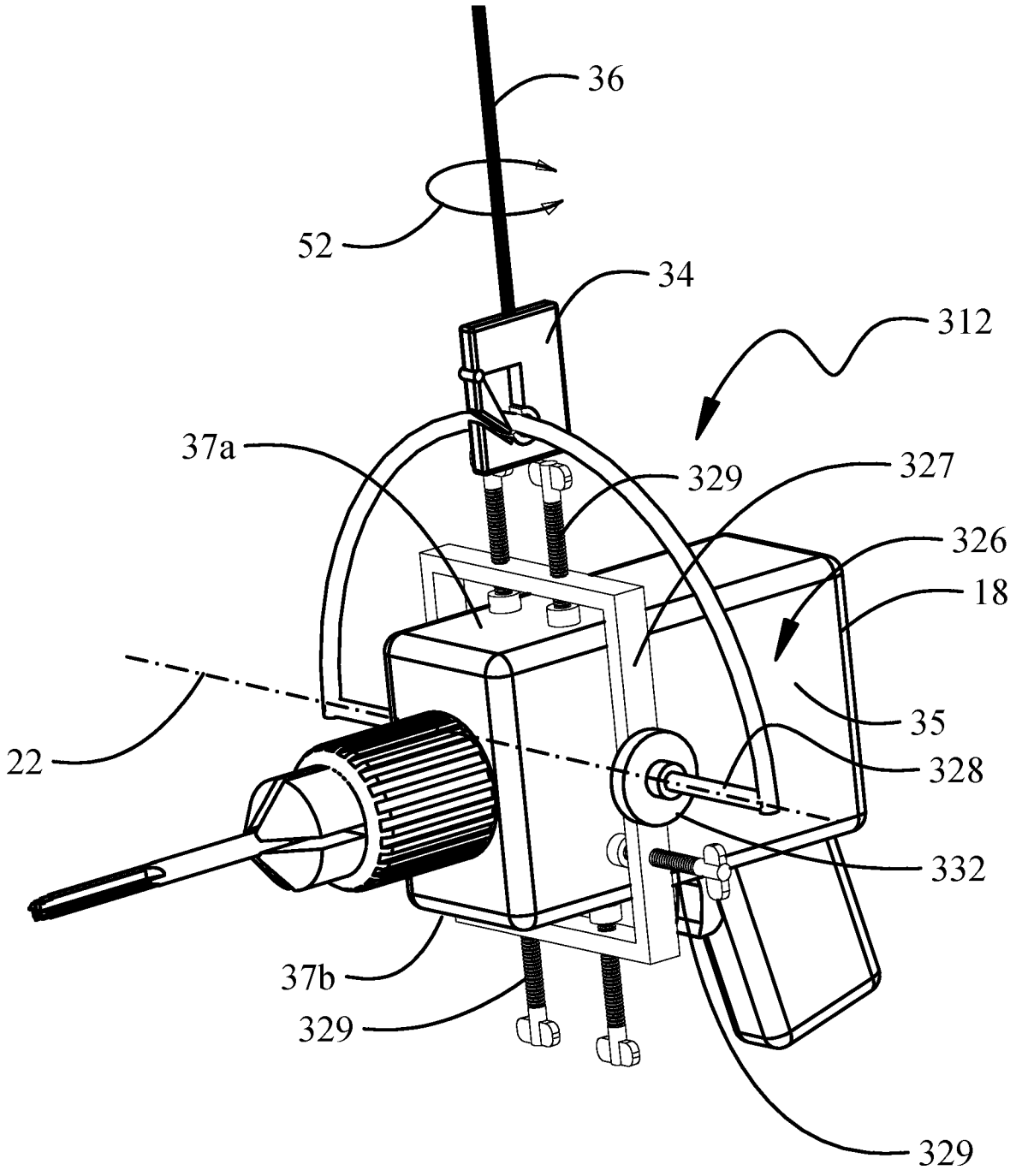
FIG. 3 shows a pictorial representation of a third exemplary implementation.

In certain implementations, it may be impractical to attach trunnions 32 directly to the tool 18. Additionally, the guide assembly 312 can provide for easy replacement of differing tools. In those implementations, as seen in FIG. 3, a mount assembly 326 may employ a frame 327 that fully or partially surrounds the tool 18 and engages the tool 18 with engagement elements such as clamps or vice screws 329 engaging the sides 35*a*, 35*b*, top 37*a*, and/or bottom 37*b* of the tool 18 with the frame 327 substantially aligned in a plane containing the horizontal axis 22. Trunnions 332 supported by the frame 327 are aligned with the horizontal axis 22 and engage the support bar 328. The support bar 328 is substantially similar to the support bar 28. Operable rotation about the roll axis 53, pitch about the axis 22, and yaw about the tether 36 are substantially identical to the prior described implementations.

Figure 4:
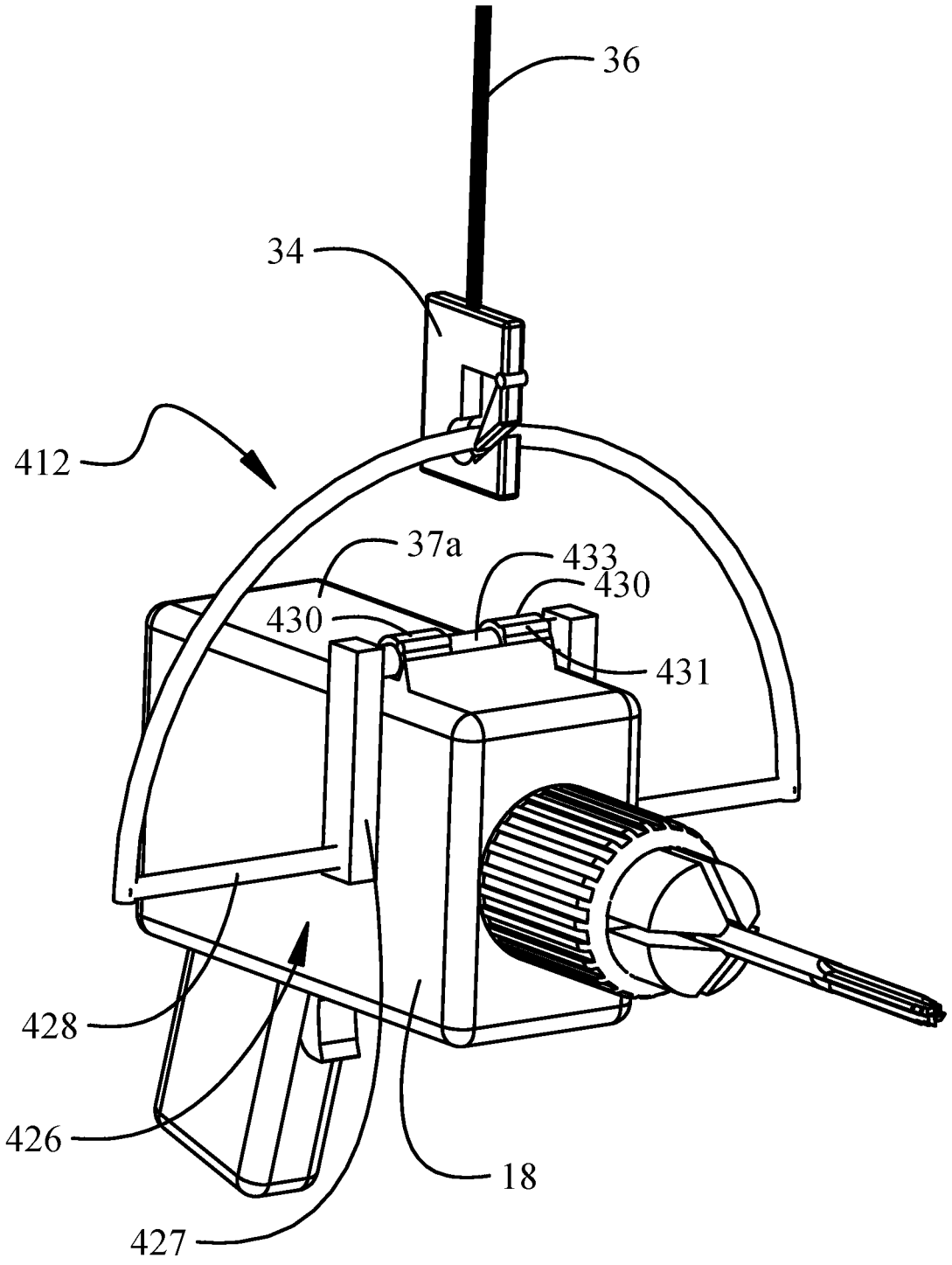
FIG. 4 shows a pictorial representation of a fourth exemplary implementation.

In yet other exemplary implementations in which only small pitch variations will occur or where attachment of the guide assembly 412 to the tool 18 is most easily accomplished on the top 37*a* of the tool 18, a mount assembly 426 may be employed as shown in FIG. 4. In this implementation, a support bar 428 engages a yoke 427 that extends over the top 37*a* of the tool 18. The support bar 428 is substantially similar to the support bar 28. The yoke 427 incorporates a rod 433 engaged by one or more clevises 430 mounted to the top 35*a* of the tool 18. The clevises 430 may have hinges 431 that allow removal of the rod 433 for exchange of tools in the guide assembly 412. The rod 433 is rotatable within the clevises 430 allowing rotation of the tool 18 in pitch. While the resulting axis of rotation is slightly displaced from the center of gravity of the tool 18, any resulting torque on the operator's hand, wrist, or arm, may be insignificant or unobjectionable. Roll rotation and yaw rotation of the tool 18 are identical to roll and yaw for the previously described implementations with no imposition of torque because the rotations take place in axes 22, 53 aligned with the center of gravity of the tool 18.

Figure 5A:
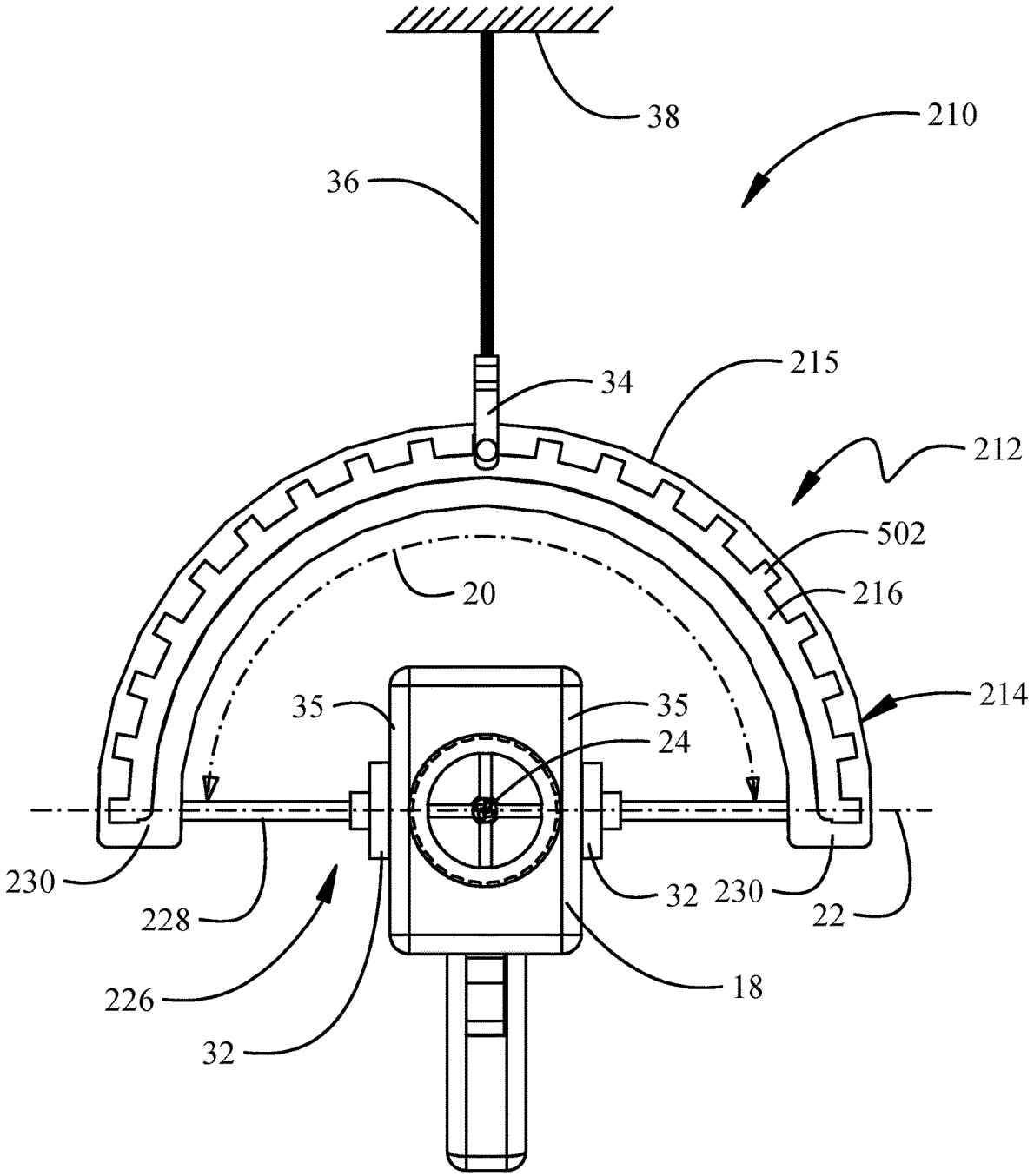
FIGS. 5A and 5B show exemplary implementations with engaging indices in the arcuate guide.
Figure 5B:
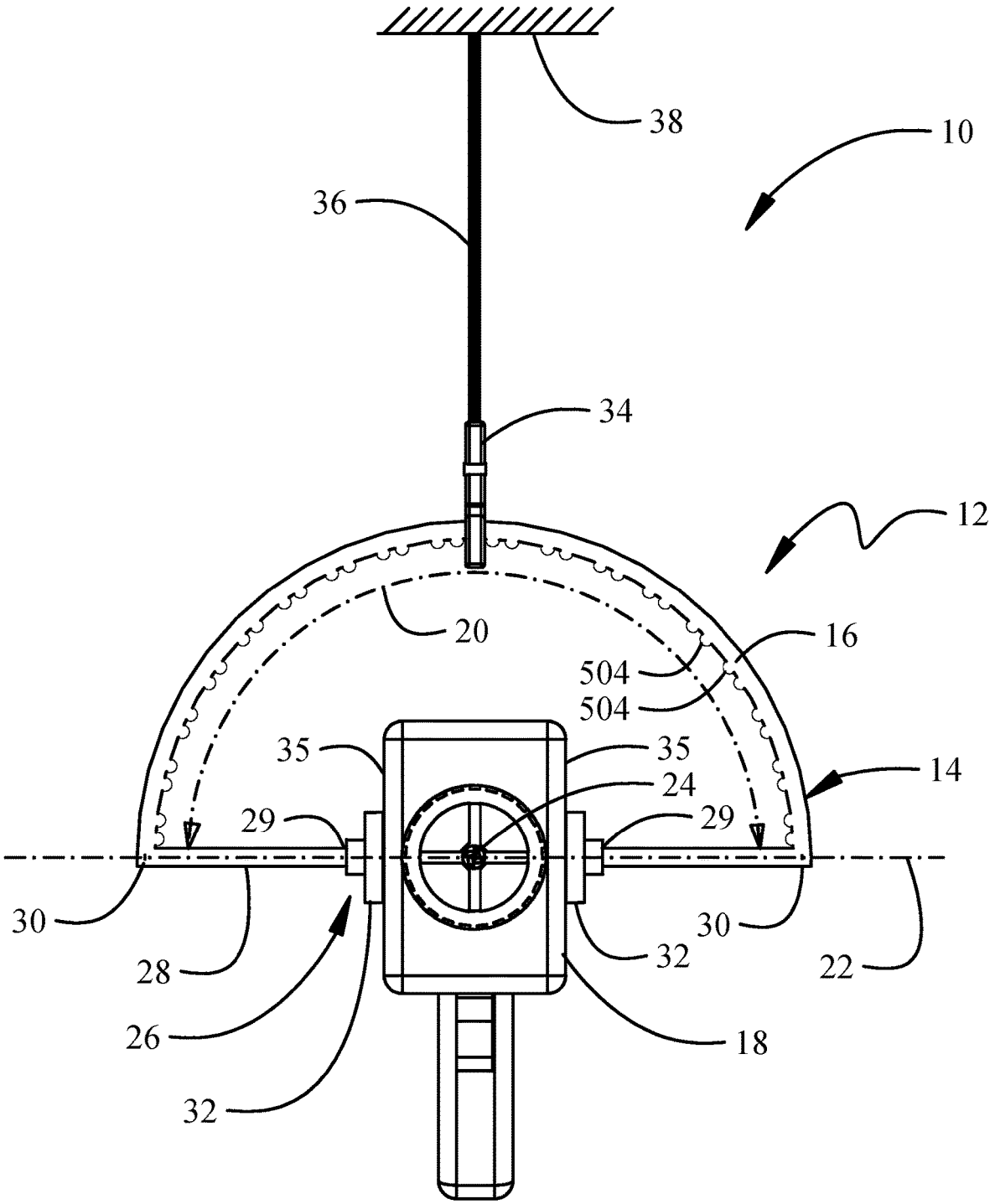

As seen in FIGS. 5A and 5B, roll rotation of the tool 18 in the guide assembly 12, 212, 412 may be controlled by addition of engaging indices at predetermined angles. For example, the engaging indices can be fixed indentations or notches 502 in the arcuate slot 216 or spaced-apart, fixed indentations or bumps 504 on the rail 16. The engaging indices 502, 504 releasably engage the clip 34, 234 (or tether loop) to temporarily fix rotation of the tool 18 in roll. The engaging indices 502, 504 are desirable where repetitive positioning at specific roll angle(s) can occur during operation of the tool 18.

Figure 6:
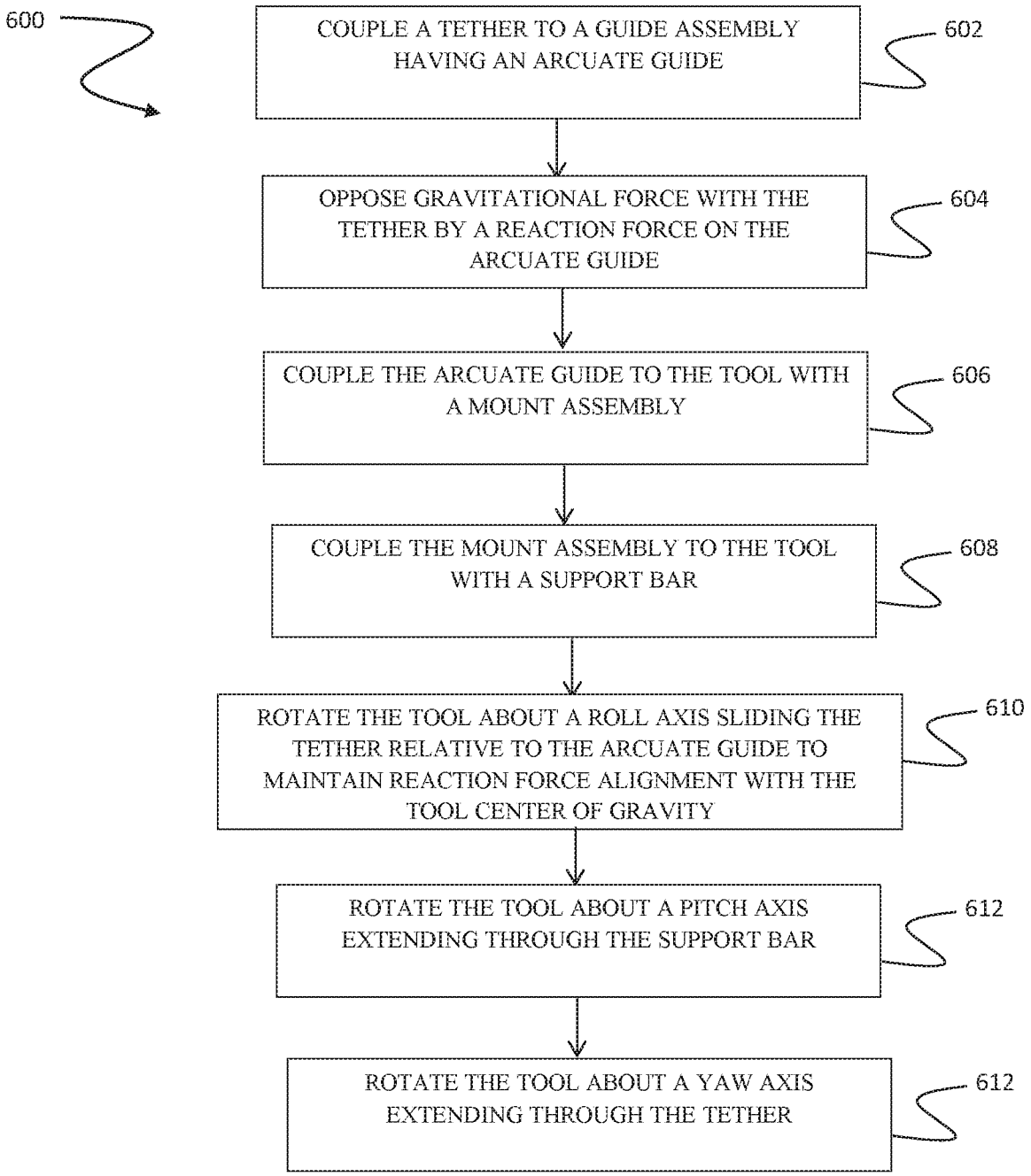
FIG. 6 is a flow chart showing a method for operation of a tool employing the disclosed implementations.

The implementations described provide a method 600 as shown in FIG. 6 for operation of a tool 18 having a tool center of gravity 24. A tether 36 is coupled to a guide assembly 12, 212, 312 412, step 602, where the guide assembly 12, 212 includes an arcuate guide 14, 214 configured to be coupled to the tether 36. The tether 36 opposes gravitational force with a reaction force 48 on the arcuate guide 14, step 604 A mount assembly 26, 226 couples the arcuate guide 14, 214 to the tool 18, step 606, and at least one support bar 28, 228 couples to the arcuate guide 14, 214 and the mount assembly 26, 226, step 608. The arcuate guide 14, 214, the mount assembly 26, 226, and the at least one support bar 28, 228 maintain the reaction force 48 in alignment with a center of gravity 24 of the tool 18 as the tool 18 is rotated with respect to the tether 36. The tool 18 is rotated about a roll axis 53 such that the tether 36 slides relative to the arcuate guide 14, 214 to maintain the reaction force 48 in alignment with the tool center of gravity 24, step 610. Additionally or alternatively, the tool 18 may be rotated about a pitch axis 20 extending through the at least one support bar 28, 228 at step 612, and/or the tool 18 may be rotated about a yaw axis 27 extending through the tether, step 614.

Having now described various implementations in detail as required by the patent statutes, those skilled in the art will recognize modifications and substitutions to the specific implementations disclosed herein. Such modifications are within the scope and intent of the present invention as defined in the following claims.

What is claimed is:

1. A guide assembly for supporting a tool, the guide assembly comprising:

an arcuate guide configured to have a tether coupled thereto, wherein the arcuate guide is configured to apply a reaction force to the tether to oppose gravitational force acting on the tool;

a yoke having a rod removably engaged by one or more clevises mounted to a top of the tool and configured to couple the arcuate guide to the tool, said rod rotatable within the one or more clevises; and at least one support bar coupled to the arcuate guide and the yoke, wherein the arcuate guide, the yoke, and the at least one support bar are configured to maintain the reaction force in alignment with a center of gravity of the tool as the tool is rotated in roll and yaw with respect to the center of gravity.

2. The guide assembly as defined in claim 1 wherein the arcuate guide comprises a rail.

3. The guide assembly as defined in claim 2 wherein the rail is a circular arc.

4. The guide assembly as defined in claim 1 wherein the arcuate guide is a plate having an arcuate slot.

5. The guide assembly as defined in claim 4 wherein the arcuate slot is a circular arc.

6. The guide assembly as defined in claim 4 wherein the at least one support bar comprises two support bars extending from end portions of the plate to engage the yoke.

7. The guide assembly as defined in claim 1 wherein the arcuate guide comprises engaging indices at predetermined angles.

8. A tool system comprising:

an overhead support having a tether coupled thereto;

a tool having a center of gravity; and a guide assembly coupled to the tool and the tether, the guide assembly comprising:

an arcuate guide configured to be coupled to the tether, the tether opposing gravitational force with a reaction force on the arcuate guide;

a yoke having a rod removably engaged by one or more clevises mounted to a top of the tool and configured to couple the arcuate guide to the tool, said rod rotatable in the one or more clevises; and at least one support bar coupled to the arcuate guide and the yoke, wherein the arcuate guide, the yoke, and the at least one support bar are configured to maintain the reaction force in alignment with the center of gravity of the tool as the tool is rotated in roll or yaw with respect to the tether.

9. The tool system as defined in claim 8 wherein the tool is a hand tool or a power tool.

10. The tool system as defined in claim 8 wherein the arcuate guide comprises a rail, and the tether includes a clip having an aperture adapted to engage the rail, the rail slidable through the clip for rotation of the tool about a roll axis.

11. The tool system as defined in claim 10 further comprising a bushing in the aperture and engaging the rail for lubricity in sliding the rail through the clip.

12. The tool system as defined in claim 10 wherein the rail comprises engaging indices including indentations or bumps on the rail at predetermined angles, the engaging indices configured to releasably engage the clip.

13. The tool system as defined in claim 8 wherein the arcuate guide comprises a plate with an arcuate slot, the tool system further comprising a clip attached to the tether and adapted to be received in the arcuate slot, the clip slidable through the slot for rotation of the tool about a roll axis.

14. The tool system as defined in claim 13 further comprising a bushing in the arcuate slot and said bushing engaging a clip of the tether for lubricity in sliding the clip through the arcuate slot.

15. The tool system as defined in claim 13 wherein the arcuate slot comprises engaging indices including indentations or bumps in the arcuate slot at predetermined angles, the engaging indices configured to releasably engage the clip.

16. The tool system as defined in claim 15 wherein the clevis mounted to the top of the tool is hinged for insertion or removal of the rod.

17. A method for operating a tool having a tool center of gravity, the method comprising:

coupling a tether to a guide assembly, the guide assembly including an arcuate guide configured to have the tether coupled thereto, the tether opposing gravitational force with a reaction force on the arcuate guide rail, a yoke having a rod removably engaged by one or more clevises mounted to a top of the tool and configured to couple the arcuate guide to the tool, with the rod rotatable in the one or more clevises, and at least one support bar coupled to the arcuate guide and the yoke;

rotating the tool about a roll axis such that the tether slides relative to the arcuate guide; and maintaining a reaction force in alignment with the tool center of gravity using the guide assembly, wherein the arcuate guide, the yoke, and the at least one support bar maintain the reaction force in alignment with the center of gravity of the tool as the tool is rotated with respect to the tether.

18. The method as defined in claim 17 further comprising rotating the tool about a yaw axis extending through the tether.

19. The method as defined in claim 17 further comprising rotating the rod within the clevis for pitch rotation.

20. The method as defined in claim 19 further comprising removing the rod from the one or more clevises to exchange the tool in the yoke.

* * * * *